US006536645B2

(12) United States Patent
Minakawa

(10) Patent No.: US 6,536,645 B2
(45) Date of Patent: Mar. 25, 2003

(54) IMAGE FORMING APPARATUS CAPABLE OF SMOOTHLY FEEDING LARGE-SIZE SHEET INTO MAIN BODY

(75) Inventor: Yoshihisa Minakawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/043,245

(22) Filed: Jan. 14, 2002

(65) Prior Publication Data

US 2002/0093134 A1 Jul. 18, 2002

(30) Foreign Application Priority Data

Jan. 12, 2001 (JP) ..... 2001-004725
Dec. 21, 2001 (JP) ..... 2001-390031

(51) Int. Cl.[7] ..... B65H 23/04

(52) U.S. Cl. ..... 226/196.1; 226/615.21; 271/8.1; 271/9.09; 271/264

(58) Field of Search ..... 271/264, 9.09, 271/8.1, 10.01; 226/196.1, 615.21; 26/12, 98; 493/8; 38/7

(56) References Cited

FOREIGN PATENT DOCUMENTS

JP 06-348089 12/1994

*Primary Examiner*—Donald P. Walsh
*Assistant Examiner*—Kaitlin Joerger
(74) *Attorney, Agent, or Firm*—Oblon, Spivak, McClelland, Maier & Neustadt, P.C.

(57) ABSTRACT

An image forming apparatus including a scanner, which includes a guide member provided at an inlet of a clearance formed below a cover of the scanner. The guide member has a substantially pentagonal shape as viewed from the top, and may also include a notch formed in the top portion of the pentagon. The guide member also includes an edge portion curled in a semicircle in an upward direction that is arranged at both sides of the notch. Further, the curled edge portion is inclined from a center of the clearance toward an edge in a length direction. When an original document having a curled leading edge is fed to the scanner, a central portion of the curled leading edge of the original document is placed beneath the edge portion of the guide member. Thus, when the curled portion of the original document hits the edge portion of the guide member, the curled portion of the original document slips beneath the edge portion while the curled portion of the original document is flattened by the curled edge portion of the guide member.

15 Claims, 4 Drawing Sheets

IMAGE FORMING APPARATUS CAPABLE OF SMOOTHLY FEEDING LARGE-SIZE SHEET INTO MAIN BODY

CROSS-REFERENCE TO RELATED APPLICATION

This document claims priority and contains subject matter related to Japanese Patent Application No. 2001-004725, filed on Jan. 12, 2001, and Japanese Patent Application No. 2001-390031, filed on Dec. 21, 2001, the entire contents of which are incorporated by reference.

BACKGROUND OF THE INVENTION

1. Field of the Invention

The present invention relates to an image forming apparatus, such as a copier, a facsimile, a printer, a scanner, and other similar apparatuses, and more particularly to an image forming apparatus in which a large-size original document or transfer sheet is smoothly fed into a main body of the image forming apparatus.

2. Discussion of the Background

A tip portion of a large-size original document or transfer sheet tends to curl. Thus, as illustrated in FIG. 1, in a background image forming apparatus, a large-size original document 1 is not easily fed into a scanner 2 for an image reading through a clearance 4 formed below a cover 3 because a tip portion 5 of the large-size original document 1 is curled. Therefore, an operator has to remove the curl of the original document 1, which is additional work for the operator. Further, when a large number of original documents are copied, the amount of work performed by the operator is significantly increased.

For example, when feeding the original document 1 with the curled portion 5, the operator may press the curled portion 5 with both hands 6 (see FIG. 2) so the curled portion 5 lies flat. However, when the original document 1 is thin, the operator may not be able to uniformly flatten the curled portion 5. Thus, a leading edge of the original document 1 forms a waveform as illustrated in FIG. 2. Then, the right and left edges of the leading edge of the original document 1, as well as the central portion, abut against the cover 3. Thus, the leading edge portion of the original document 1 cannot be fed any further or the original document 1 is folded.

SUMMARY OF THE INVENTION

Accordingly, one object of the present invention is to solve the above-noted and other problems.

To solve these and other problems, the present invention provides a novel image forming apparatus in which a large-size original document or transfer sheet is smoothly fed into a main body of the image forming apparatus without curling a leading edge portion of the original document or folding the document.

According to one example of the present invention, the image forming apparatus includes a guide member arranged in a region where an original document or transfer sheet is fed into the main body of the image forming apparatus. The guide member is provided to press and flatten the original document or transfer sheet. Further, the guide member includes an edge portion curled in an upward direction, which is arranged at a position facing a leading edge of the original document or transfer sheet.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
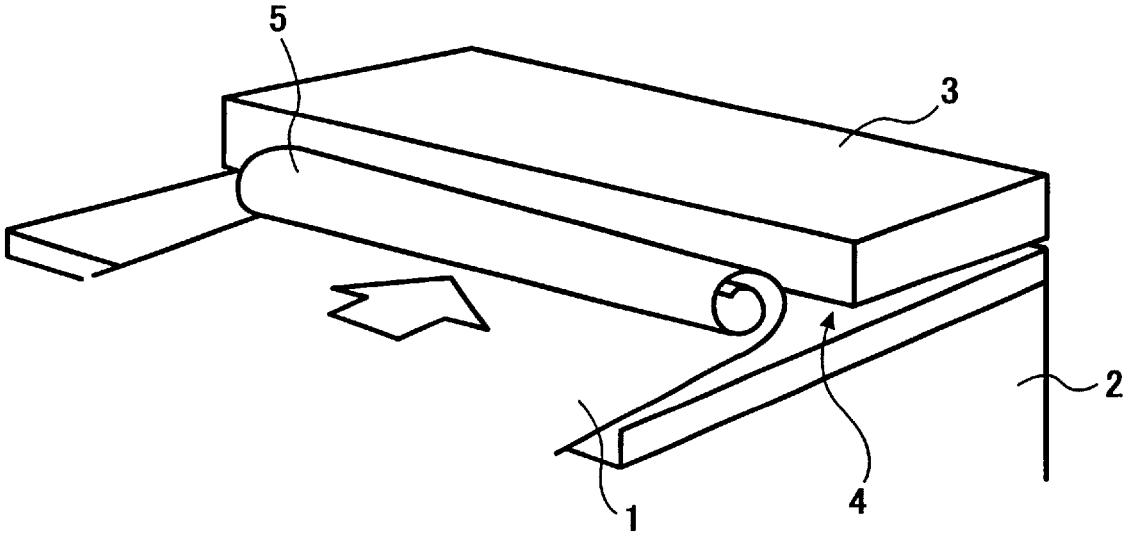
FIG. 1 PRIOR ART
FIG. 1 is a schematic drawing illustrating a perspective view of a scanner of a background image forming apparatus in which a large-size original document and transfer sheet are handled.
Figure 2:
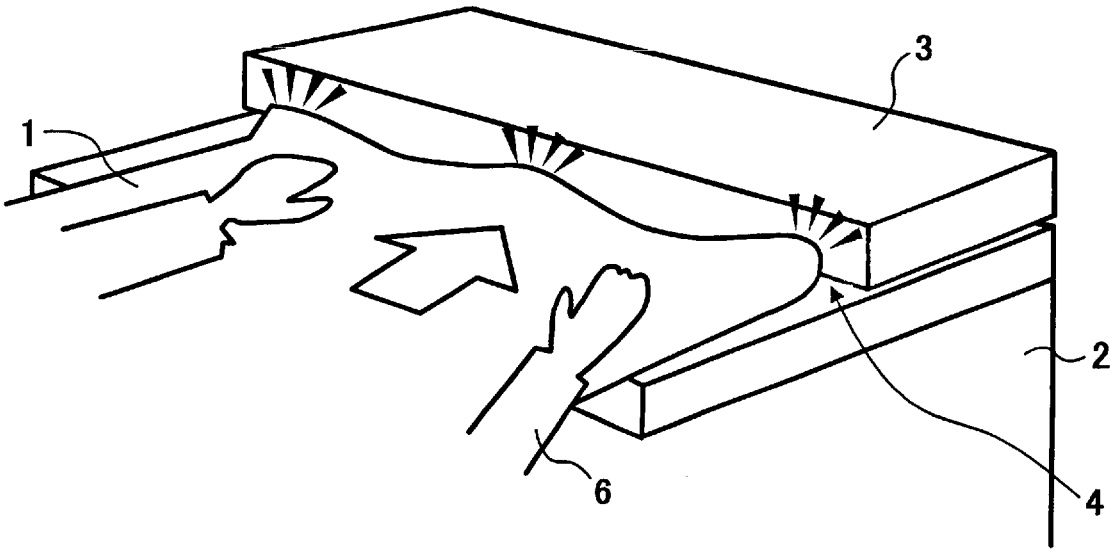
FIG. 2 PRIOR ART
FIG. 2 is a schematic drawing illustrating a perspective view of the scanner of the background image forming apparatus in which the large-size original document is not smoothly fed into the scanner.

Referring now to the drawings, wherein like reference numerals designate identical or corresponding parts throughout the several views, an example of the present invention will now be described. The same reference numerals that designate corresponding numbers discussed in FIGS. 1 and 2 are used in the description of the example of the present invention, and therefore an explanation of the identical numbers is omitted.

Figure 3:
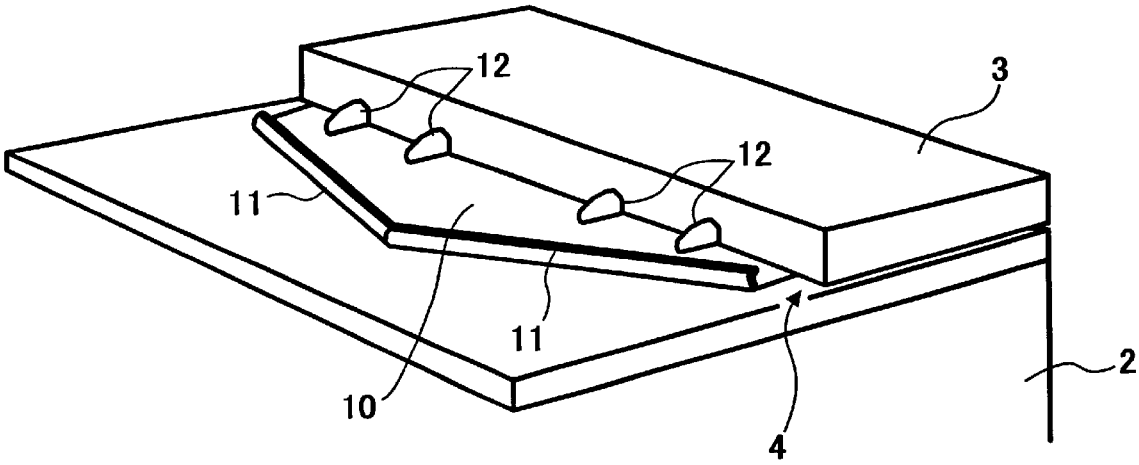
FIG. 3 is a schematic drawing illustrating a perspective view of a scanner of an image forming apparatus according to a first example of the present invention.

Turning now to FIG. 3, which is a schematic drawing illustrating a perspective view of the scanner 2 of an image forming apparatus according to a first example of the present invention. The scanner 2 illustrated in FIG. 3 is a scanner that can read an image of a large size original document 1 similar to the scanner 2 illustrated in FIG. 1. However, the scanner 2 in FIG. 3 includes a guide member 10 provided at an inlet of the clearance 4 formed below the cover 3 arranged on the top of the scanner 2.

The guide member 10 has a substantially pentagonal shape as viewed from the top. Further, the top of the pentagon is arranged at a position facing a leading edge of the original document 1. Two edge portions 11, which form the top of the pentagon, are curled in a semicircle in an upward direction. In addition, the guide member 10 is provided so the curled edge portions 11 are inclined from a center of the clearance 4 toward an edge of the clearance 4 in the length direction.

As shown, the guide member 10 also includes four stoppers 12 that abut against an edge of the cover 3 at a position directly above the clearance 4 so the guide member 10 is not further inserted into the clearance 4. In addition, the guide member 10 may be formed of a transparent or a translucid member so the original document 1 can be seen through the guide member 10. Further, a surface of the edge portions 11 that contact the original document 1 may be coated with a lubricant that produces a protective surface film made of silicone or wax (for example, SUPER DARK AND METALIC WAX, the trade name of which is SOLID WAX, produced by Wilson Co., Ltd.). Thus, friction produced between the original document 1 and the edge portions 11 is reduced so the original document 1 can be easily fed into the scanner 2.

Figure 4:
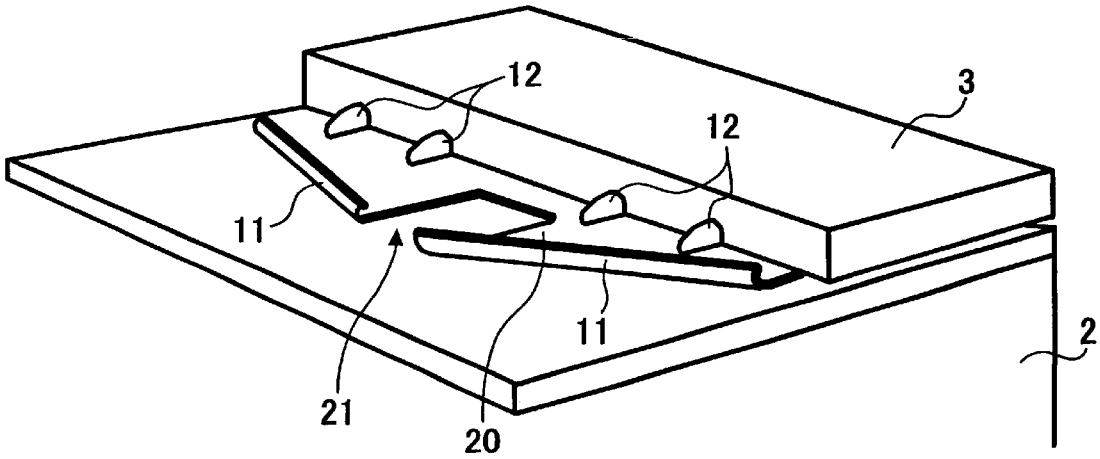
FIG. 4 is a schematic drawing illustrating a perspective view of a scanner of an image forming apparatus according to a second example of the present invention.

Turning now to FIG. 4, which is a schematic drawing illustrating a perspective view of the scanner 2 of an image forming apparatus according to a second example of the present invention. Note, an explanation of similar devices discussed in the first example is omitted in the second example.

As shown in FIG. 4, the scanner 2 includes a guide member 20 having the same shape as the guide member 10 illustrated in FIG. 3. However, the guide member 20 includes a notch 21 formed in the top portion of the pentagon. As shown, the notch 21 includes an opening arranged at a position facing a leading edge of the original document 1. Further, the curled edge portion 11 is provided at both sides of the notch 21. A size of the opening of the notch 21 in the length direction of the clearance 4 may be set so a small-size original document (such as an A-4 size original document) can be fed directly into the clearance 4. Note, however, if the size of the opening of the notch 21 is too large, a large-size original document may not be smoothly fed into the clearance 4.

Based on experiments, the present inventors have determined that both large and small size original documents are smoothly fed into the clearance 4 when the size of the open side (i.e., the side furthest from the clearance 4) of the notch 21 is set to 37 cm and the size of the base side (i.e., the side closest to the clearance 4) of the notch 21 is set to 26 cm.

Further, it is preferable the center of the notch 21 in the widthwise direction corresponds to the center of the cover 3 or clearance 4. With this arrangement, even a small-size original document can be fed into the clearance 4 without causing a skew of the original document. The guide member 20 is also provided so the curled edge portions 11 are inclined from a center of the clearance 4 toward an edge of the clearance 4 in the length direction.

Figure 5A:
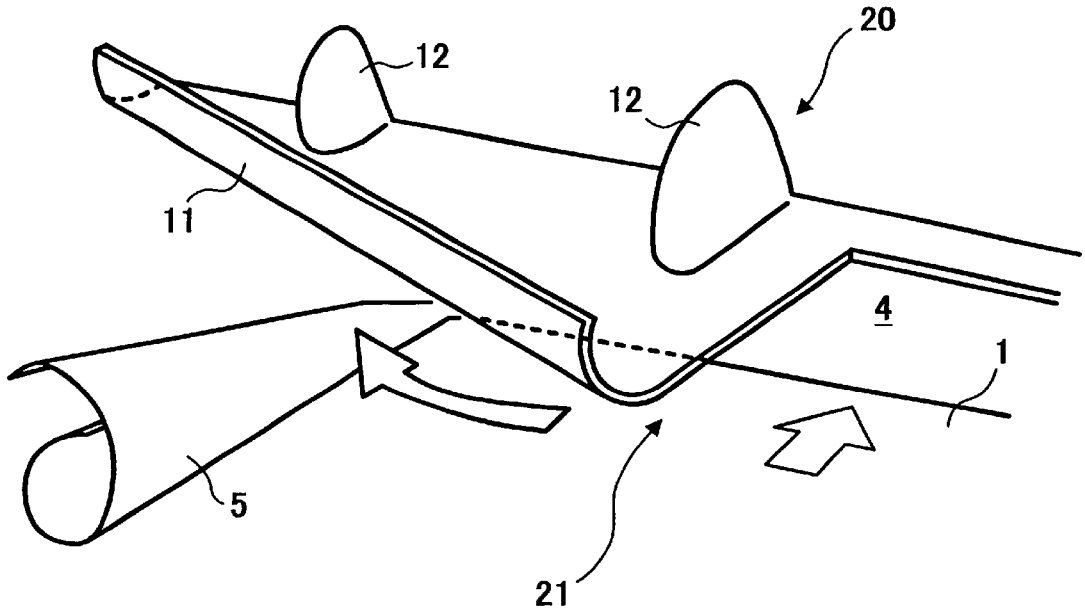
FIGS. 5A and 5B are drawings illustrating an original document being fed into the scanner using a guide member illustrated in FIG. 4.
Figure 5B:
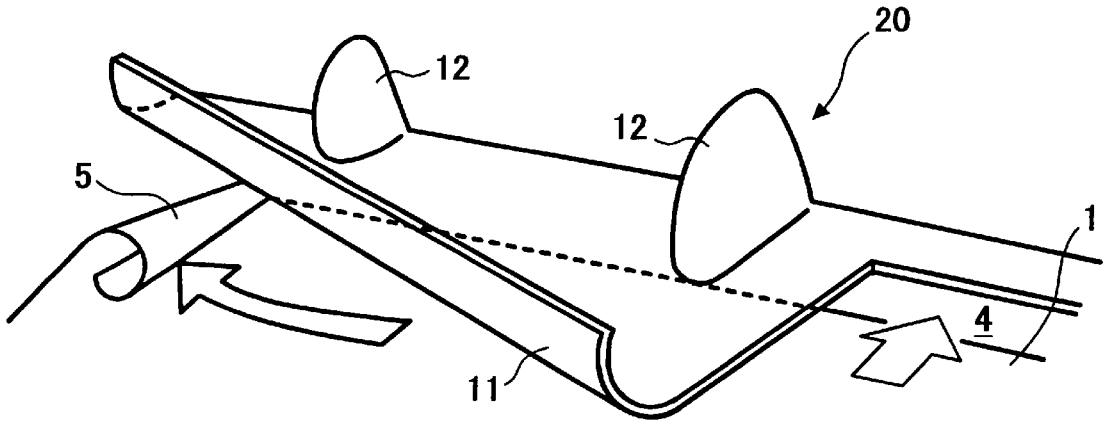

Turning now to FIGS. 5A and 5B, which are drawings illustrating an original document fed into the clearance 4 using the guide member 20 illustrated in FIG. 4. When the original document 1 with a curled leading edge is fed into the scanner 2 through the clearance 4, a central portion of the curled leading edge of the original document 1 may be flattened by hand. Then, the flattened central portion of the leading edge of the original document 1 is placed beneath the edge portions 11 at the right and left sides of the notch 21. When the original document 1 is further fed toward the clearance 4, a side portion of the curled leading edge of the original document 1 slides beneath the edge portion 11 of the guide member 20.

Thus, when the curled portion 5 hits the edge portion 11, the curled portion 5 slips beneath the guide member 20 and is flattened by the curl of the edge portion 11. Further, when a surface of the edge portion 11 that contacts the original document 1 is coated with a lubricant like the above-described first example, friction produced between the original document 1 and the edge portion 11 is reduced, resulting in the original document 1 being smoothly fed into the clearance 4.

Further, if necessary, the original document 1 may be fed further toward the clearance 4 while flattening the curled portion 5 by hand so the curled portion 5 smoothly slips beneath the edge portion 11 of the guide member 20. Thus, the curled portion 5 of the original document 1 is pressed and flattened by the guide member 20 so the whole curled portion 5 of the original document 1 is finally flattened as illustrated in FIG. 5B. Hence, the entire leading edge of the original document 1 is smoothly fed into the clearance 4. Then, the original document 1 is fed into the scanner 2.

Figure 6A:
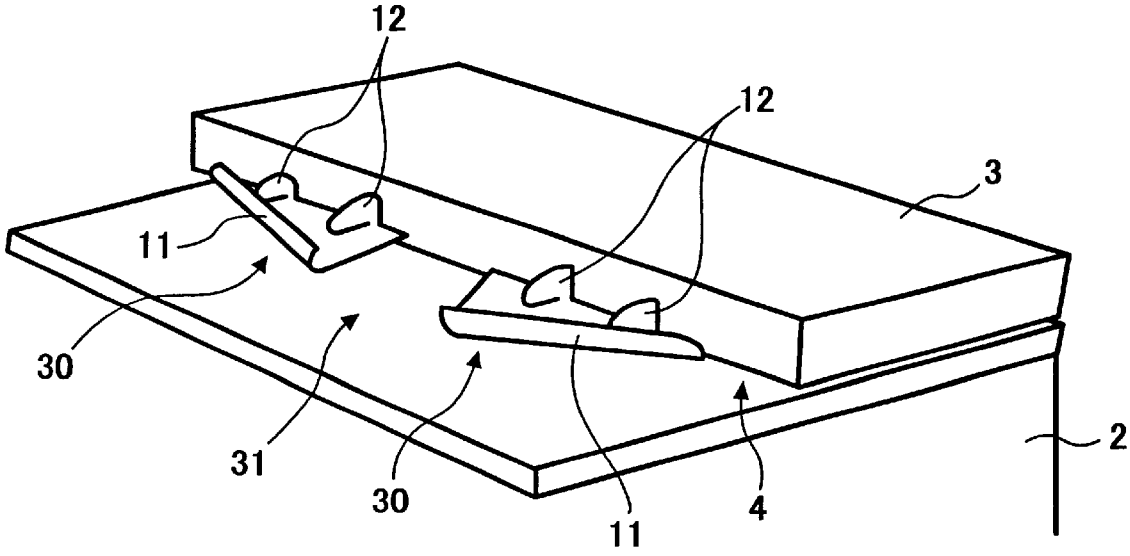
FIG. 6A is a schematic drawing illustrating a perspective view of a scanner of an image forming apparatus according to a third example of the present invention.
Figure 6B:
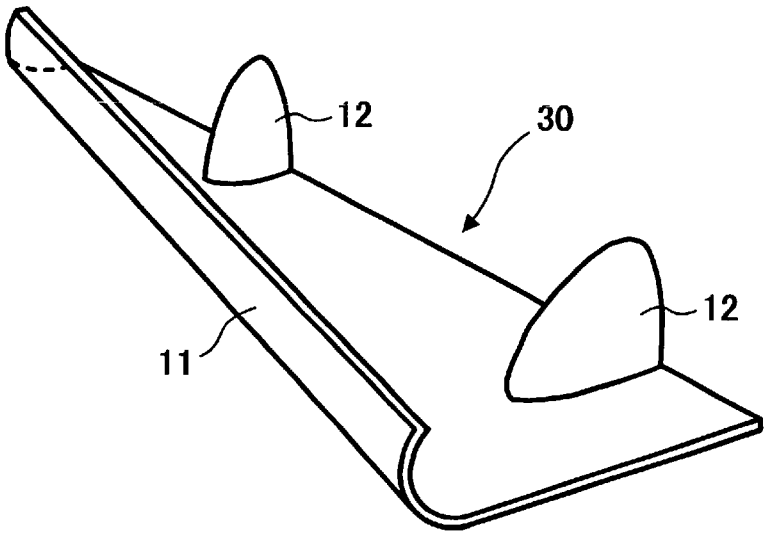
FIG. 6B is a schematic drawing illustrating a perspective view of a guide member according to the third example of the present invention.

Turning now to FIG. 6A, which is a schematic drawing illustrating a perspective view of the scanner 2 of an image forming apparatus according to a third example of the present invention and FIG. 6B, which is a schematic drawing illustrating a perspective view of a guide member 30. As shown, the scanner 2 includes a pair of guide members 30 at an inlet of the clearance 4 formed below the cover 3 similar to the above-described first and second examples. The guide member 30 includes a substantially triangular shape, as viewed from the top thereof. The guide member 30 also includes the curled edge portion 11.

As shown, the edge portion 11 is arranged at a position facing a leading edge of the original document 1. A space 31 formed between the pair of guide members 30 performs similar functions as the notch 21 described in the second example. Because the basic structure and operation of the guide member 30 are identical to those of the first and second examples except for the space 31, a further detailed explanation of the third example is omitted.

Obviously, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus for handling a large-size original document and transfer sheet, comprising:

a guide member provided at an inlet where the original document or transfer sheet is fed into a main body of the image forming apparatus, and configured to press and flatten the original document or transfer sheet fed into the main body of the image forming apparatus, wherein the guide member includes an edge portion arranged at a position facing a leading edge of the original document or transfer sheet, and wherein the edge portion is curled in an upward direction and symmetrically inclines from a center of the inlet toward an edge of the inlet.

2. The image forming apparatus according to claim 1, wherein the guide member further includes a pair of members parted at a center of the inlet.

3. The image forming apparatus according to claim 1, wherein the guide member further includes a notch having an opening in a direction facing the leading edge of the original document or transfer sheet.

4. The image forming apparatus according to claim 1, wherein the guide member further includes a stopper abutting against a member forming the inlet and configured to stop the guide member from moving while the original document or transfer sheet is fed.

5. The image forming apparatus according to claim 1, wherein a surface of the curled edge portion contacting the original document or transfer sheet comprises a lubricant coating.

6. An image forming apparatus for handling a large-size original document and transfer sheet, comprising:

guide means provided at an inlet where the original document or transfer sheet is fed into a main body of the image forming apparatus, and for pressing and flattening the original document or transfer sheet fed into the main body of the image forming apparatus, wherein the guide means includes an edge portion arranged at a position facing a leading edge of the original document or transfer sheet, and wherein the edge portion is curled in an upward direction and symmetrically inclines from a center of the inlet toward an edge of the inlet.

7. The image forming apparatus according to claim 6, wherein the guide means further includes a pair of members parted at a center of the inlet.

8. The image forming apparatus according to claim 6, wherein the guide means further includes a notch having an opening in a direction facing the leading edge of the original document or transfer sheet.

9. The image forming apparatus according to claim 6, wherein the guide means further includes stopper means abutting against a member forming the inlet and for stopping the guide member from moving while the original document or transfer sheet is fed.

10. The image forming apparatus according to claim 6, wherein a surface of the curled edge portion contacting the original document or transfer sheet comprises a lubricant coating.

11. A method of feeding a large-size original document and transfer sheet into an image forming apparatus, comprising:

providing a guide member at an inlet where the original document or transfer sheet is fed into a main body of the image forming apparatus so the original document or transfer sheet is pressed and flattened while the original document or transfer sheet is fed into the main body of the image forming apparatus, wherein the guide member includes an edge portion at a position facing a leading edge of the original document or transfer sheet, and wherein the edge portion is curled in an upward direction and symmetrically inclines from a center of the inlet toward an edge of the inlet.

12. The method according to claim 11, wherein the guide member further includes a pair of members parted at a center of the inlet.

13. The method according to claim 11, wherein the guide member further includes a notch having an opening in a direction facing the leading edge of the original document or transfer sheet.

14. The method according to claim 11, wherein the guide member further includes a stopper abutting against a member forming the inlet and configured to stop the guide member from moving while the original document or transfer sheet is fed.

15. The method according to claim 11, wherein a surface of the curled edge portion contacting the original document or transfer sheet comprises a lubricant coating.

* * * * *